United States Patent [19]

Jenkins

[11] 4,132,492

[45] Jan. 2, 1979

[54] CONCRETE SCREED MACHINE

[76] Inventor: George P. Jenkins, P.O. Box 41, Geuda Springs, Kans. 67051

[21] Appl. No.: 876,903

[22] Filed: Feb. 13, 1978

[51] Int. Cl.[2] ..... E01C 19/22

[52] U.S. Cl. ..... 404/119; 242/158.3

[58] Field of Search ..... 404/118, 119, 120, 114, 404/101; 242/158.3; 52/678

[56] References Cited

U.S. PATENT DOCUMENTS

| | | | |
|---|---|---|---|
| 1,230,768 | 6/1917 | Parrish | 404/28 |
| 1,440,606 | 1/1923 | Johnston | 404/119 |
| 1,591,593 | 7/1926 | Weller | 404/119 |
| 1,833,546 | 11/1931 | Wight | 404/119 |
| 1,875,467 | 9/1932 | Knoerzer | 242/158.3 |
| 2,306,671 | 12/1942 | Tamblyn | 52/678 |
| 2,510,523 | 6/1950 | Schiavi | 404/119 X |
| 2,599,330 | 6/1952 | Jackson | 404/114 |
| 3,309,066 | 3/1967 | Carlson | 242/158.3 |
| 3,412,658 | 11/1968 | Griffin | 404/119 |
| 3,767,312 | 10/1973 | Raymond | 404/106 |

*Primary Examiner*—Nile C. Byers, Jr.

*Attorney, Agent, or Firm*—Laney, Dougherty, Hessin & Beavers

[57] ABSTRACT

A self-propelled concrete screed machine is provided having a winch and cable propulsion system comprised of a pair of cable spools and two cables, one wound upon each spool, and a pair of level wind mechanisms providing a reciprocal guiding motion of the cables across the length of the spools, so that each cable will be received on its respective spool in a series of concentric layers comprised of multiple side by side wraps of the cable. A portable, easily disassembled, framework including: a main frame carrying the winch and cable system and its prime mover; a pair of outer frame members each carrying a cable guide pulley; and two pairs of screed board guide handles, one of which carries a remote prime mover control, are also provided. The concrete screed machine is guided across the concrete surface being screeded by an elongated guide shoe which slidingly engages a plurality of guide supports affixed to the surface upon which the concrete is being poured.

16 Claims, 6 Drawing Figures

CONCRETE SCREED MACHINE

BACKGROUND OF THE INVENTION

1. Field of the Invention

This invention relates generally to apparatus for screeding concrete and the like, and more particularly, but not by way of limitation, to apparatus for providing a self-propelled concrete screeding machine.

2. Description of the Prior Art (Prior Art Statement)

The following statement is intended to be a Prior Art Statement in compliance with the guidance and requirements of 37 CFR SS1.56, 1.97 and 1.98 and with S609 of the Manual of Patent Examining Procedure The most relevant prior art reference known to Applicant is U.S. Pat. No. 3,412,658 issued to Griffin. Griffin is relevant in that it shows a self-propelling concrete screeding machine which uses a cable and winch assembly to provide for propulsion of the screed machine. It will be noted, however, that the Griffin device provides only a single winch 82 about which is wound a single cable 84, said single cable 84 being attached to the winch at a point intermediate the ends of the cable. Furthermore, it will be noted that the Griffin device does not include any level wind mechanism so as to provide for an even take-up of each end of the single cable 84. Two problems are inherent in such a self-propelling mechanism as is seen in Griffin. The lack of a level wind mechanism allows the cable to wrap upon the winch in a random manner thereby providing for an uneven take-up of each end of the cable. This causes one end of the Griffin apparatus to be pulled at a faster rate than the other end thereby propelling the Griffin apparatus in an irregular fashion.

Furthermore, the addition to Griffin of a satisfactory level wind mechanism would be frustrated by the fact that the Griffin device comprises only a single cable attached at an intermediate point to the winch. As will be seen in the later description of the present invention, in order to provide a satisfactory level wind mechanism it is necessary that a pair of level wind mechanisms be provided, each mechanism operating on a separate cable. This allows the two separate cables of the present invention to be wound upon separate spools with flanges intermediate the spools preventing interference of one cable with the other. Such a construction is not possible with the Griffin apparatus. The Griffin device also shows the use of an eccentric counter weight driven by the prime mover of the screeding device thereby imparting a vibrational motion to the screed machine.

U.S. Pat. Nos. 3,256,788 to Schweihofer, et al. and 2,306,671 to Tamblyn are of interest in that they also show a use of eccentrically mounted counter weights to impart a vibrational motion to a screeding machine.

U.S. Pat. Nos. 3,377,933 to Dale and 1,390,479 to Baker are of interest in that they show the use of winch and cable apparatus for providing propulsion means for paving machines. It will be apparent from an inspection of those two references that the propulsion means there provided are of considerably different design than that of the present invention.

Other references of somewhat peripheral interest showing various designs of concrete screeding machines are U.S. Pat. Nos. 3,435,740 to McGall; 3,368,466 to Rowe; and 2,813,467 to Vigneri.

Thus, it is seen that none of the prior art references disclose a self-propelled screeding machine having a winch and cable propulsion means provided with level wind mechanisms so as to cause the cables to be evenly wound upon the winch, thereby providing for an even take-up of each cable so that the screeding machine will be propelled in a regular fashion and will not be twisted to one side or the other. Furthermore, numerous refinements of the screeding machine of the present invention, such as the elongated guide shoe, and the improved demountable portable framework are not disclosed by any of the above references.

SUMMARY OF THE INVENTION

A self-propelled concrete screed machine is provided having a winch and cable propulsion system comprised of a pair of cable spools and two cables, one wound upon each spool, and a pair of level wind mechanisms providing a reciprocal guiding motion of the cables across the length of the spools, so that each cable will be received on its respective spool in a series of concentric layers comprised of multiple side by side wraps of the cable. A portable, easily disassembled, framework including: a main frame carrying the winch and cable system and its prime mover; a pair of outer frame members each carrying a cable guide pulley; and two pairs of screed board guide handles, one of which carries a remote prime mover control, are also provided. The concrete screed machine is guided across the concrete surface being screed by an elongated guide shoe which slidingly engages a plurality of guide supports affixed to the surface upon which the concrete is being poured.

It is therefore a general object of the present invention to provide an apparatus for screeding concrete.

A further object of the present invention is to provide a self-propelled concrete screeding machine.

Another object of the present invention is to provide a self-propelled concrete screeding machine having a pair of winch and cable propulsion means, each propulsion means including a level wind mechanism.

Yet another object of the present invention is the provision of a self-propelled concrete screeding machine which is comprised of a number of frame portions which can be readily disassembled so that the screeding machine may be easily transported from job to job in the back of a conventional pick-up truck.

Another object of the present invention is the provision of a concrete screed machine having an improved guide means comprised of an elongated guide shoe.

Other and further objects, features and advantages of the present invention will be readily apparent to those skilled in the art upon a reading of the description of preferred embodiments which follows when taken in conjunction with the accompanying drawings.

DETAILED DESCRIPTION OF THE PREFERRED EMBODIMENTS OF THE INVENTION

Figures 1, 2:
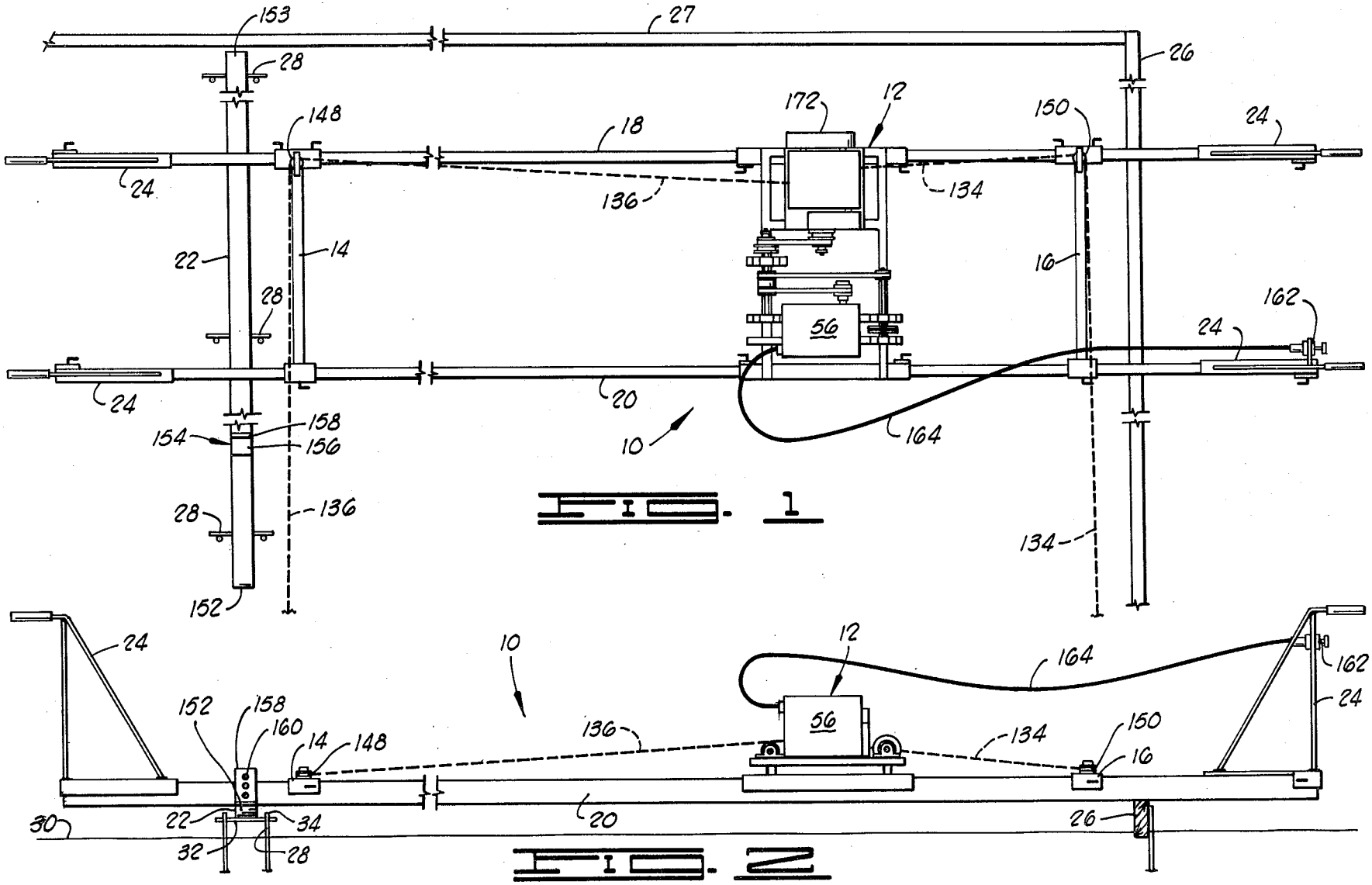
FIG. 1 is a plan view of the screeding machine of the present invention in place upon a framework for receiving the concrete paving.
FIG. 2 is a front elevation of the apparatus of FIG. 1.

Referring now to the drawings and particularly to FIG. 1, the concrete screed machine of the present invention is shown and generally designated by the numeral 10. The concrete screed machine 10 includes a propulsion system generally designated by the numeral 12, a pair of outer frame assemblies 14 and 16, a pair of substantially parallel screed boards 18 and 20, and an elongated slide shoe 22. Also included at each end of the screed boards 18 and 20 are guide handles 24.

The concrete screed machine 10 is shown in FIG. 1 in place upon a pouring frame, including pouring frame members 26 and 27, which defines the outer edges of the concrete surface to be screeded by the screed machine. Referring now to FIG. 2, an elevational view of the concrete screed machine 10 is shown. It is seen that the right most end of the screed machine 10, as viewed in FIG. 2, is supported by the pouring frame member 26 which is in sliding engagement with the screed boards 18 and 20. The left most end of the screed machine is supported by a plurality of guide supports 28 which are driven into the ground surface 30 upon which the concrete is being placed. The guide supports 28 have a horizontal portion 32 upon which the elongated slide shoe 22 is slidingly supported. The guide supports 28 have a pair of vertical extensions 34 extending above the horizontal bar 32. The vertical extensions 34 serve to prevent the elongated guide shoe 22 from sliding sideways out of engagement with the guide supports 28.

As can be seen in FIGS. 1 and 2, the use of the elongated guide shoe 22 along with a plurality of guide supports 28 permits the concrete screed machine 10 to be used to finish surfaces of large areas of concrete where the overall width of the area is such that it cannot be finished within a single traverse by the screed machine. By using the guide supports 28, that portion of the concrete surface between the guide supports 28 and the pouring frame member 26 can be finished and then the guide shoes 28 can be left in place and covered with concrete when the remaining portion of the area within the pouring frame is filled with concrete.

Figure 3:
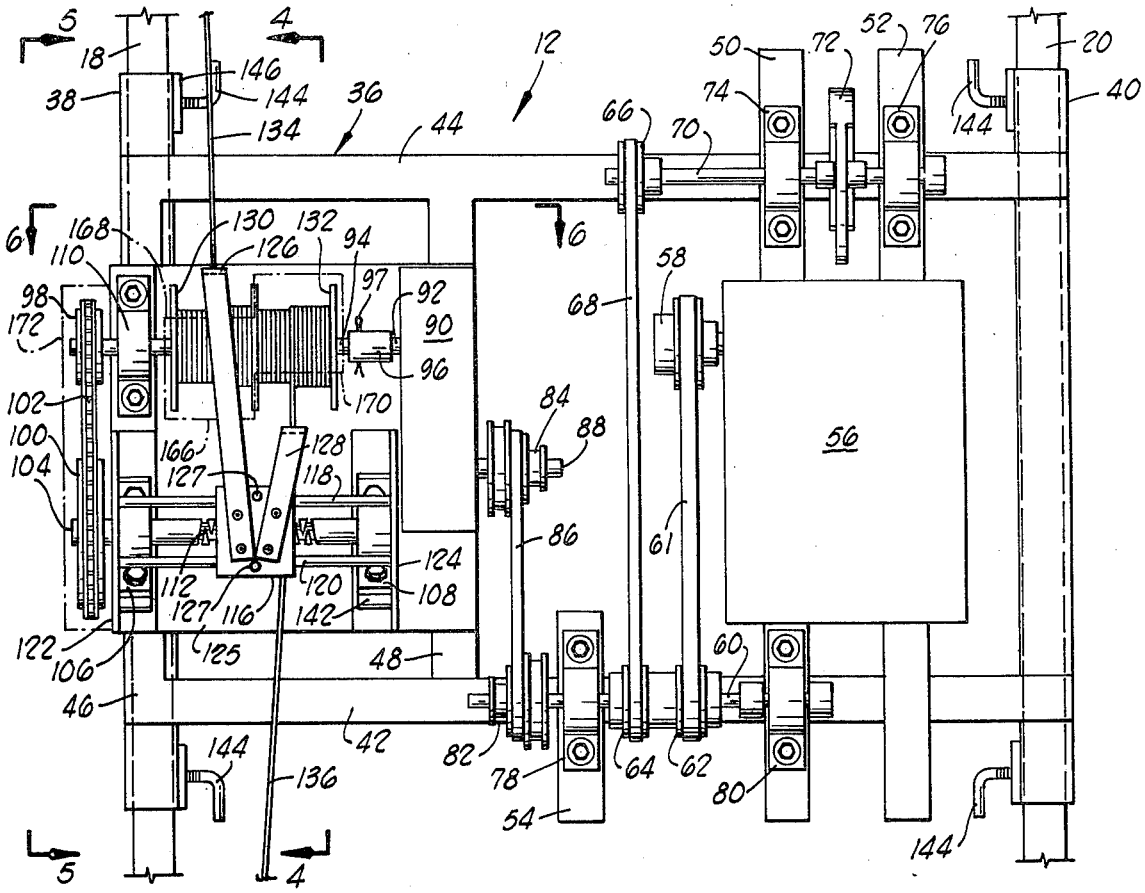
FIG. 3 is a plan view of the propulsion system of the present invention showing the prime mover, the eccentric balance weight, and the dual winch and cable means with level wind mechanisms.

Referring now to FIG. 3, an enlarged plan view of the propulsion system 12 is seen. The propulsion system 12 is comprised of a rectangular main frame generally designated by the numeral 36. The frame 36 includes a pair of screed board clamp members 38 and 40 across which are supported a pair of longitudinal frame members 42 and 44, connected at one end and at an intermediate portion by transverse frame members 46 and 48, and spanned at another intermediate portion by transverse supports 50 and 52. Additionally, at another intermediate portion there is a partial transverse support 54 attached to the longitudinal frame member 42.

The propulsion system 12 is further comprised of a prime mover 56 supported upon the transverse supports 50 and 52. A first pulley 58 driven by the prime mover 56 drives an intermediate idler shaft 60 through a first belt 61 and a second pulley 62. From a third pulley 64 mounted upon the idler shaft 60 is driven a fourth pulley 66 by means of a second belt 68.

The fourth pulley 66 drives a vibrator shaft 70 upon which is mounted an eccentrically balanced weight 72 which is mounted between a pair of pillow blocks 74 and 76 which support the vibrator shaft 70 upon the transverse supports 50 and 52.

The idler shaft 60 is supported between a pair of pillow blocks 78 and 80. At one end of the idler shaft 60 is attached a first set of variable ratio drive pulleys 82.

A second set of variable ratio drive pulleys 84 is driven by a third belt 86. The second variable ratio drive pulleys 84 are mounted upon gear box input shaft 88 which drives the gear box 90.

A gear box output shaft 92 is driven by a set of intermediate gears (not shown) inside the gear box. The output shaft 92 is connected to a winch shaft 94 by means of a coupling 96. The coupling 96 is provided with shear pin means 97 which provides a safety release for disconnecting winch shaft 94 from the output shaft 92 in the event the screed machine 10 should become lodged against the propelling motion of the winch and cable system and the winch shaft 94 be restrained from rotating. At the opposite end of the winch shaft 94 from the coupling 96 is a small transfer gear 98 which drives a large transfer gear 100 by means of a drive chain 102. The gears 98 and 100 and the chain 102 may be replaced by an equivalent belt and pulley system or by a pair of intermeshed driving gears.

The large transfer gear 100 is mounted upon level wind shaft 104 which is supported by a pair of pillow blocks 106 and 108. The winch shaft 94 is supported at one end by the pillow block 110, and at the other end by its connection to the gear box output shaft 92.

The level wind shaft 104 is provided with double threaded portion 112 within which is carried a follower key 114. The follower key 114 is pivotallly mounted within carrier block 116 which is slidingly carried upon a pair of guide shafts 118 and 120 which are rigidly attached at their ends to level wind support plates 122 and 124. The support plates 122 and 124 are mounted upon bottom plate 125 which spans transverse frame members 46 and 48. The guide shafts 118 and 120 slidingly engage a pair of parallel bores disposed in the carrier block 116. Communicating with said bores are a pair of conventional lubrication fittings 127. Attached to the upper surface of the carrier block 116 are level wind guide fingers 126 and 128.

Figure 6:
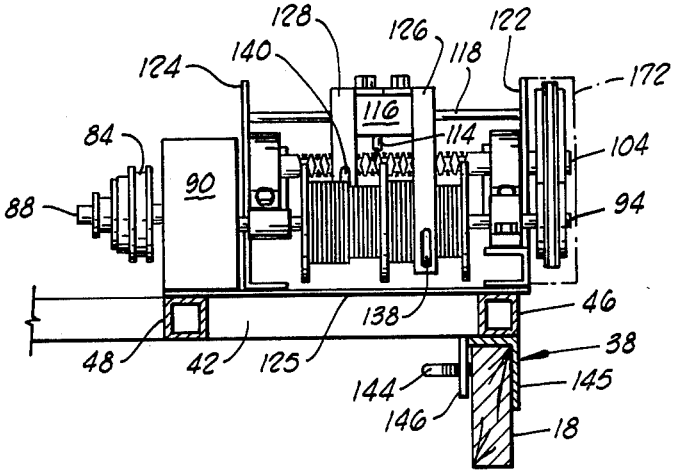
FIG. 6 is a partly sectional elevation view of the propulsion system of FIG. 3 taken along the lines 6—6.

Attached to the winch shaft 94 are first and second winch spools 130 and 132. Attached to and wound about the winch spool 130 is a first cable 134. Attached to and wound about the winch spool 132 is a second cable 136. The first cable 134 is guided in a slot 138 in guide finger 126, and the second cable 136 is guided in a slot 140 in the second finger 128 as is best seen in FIG. 6.

As the winch shaft 94 is driven by the output shaft 92 from the gear box 90, the cables 134 and 136 are wound upon their respective aligned adjacent cable spools 130 and 132. Each of the cables 134 and 136 is guided by one of the guide fingers 126 and 128 respectively as the cable winds upon the spool, so as to cause the cable to wind upon the spool in even layers. That is, as the cable winds upon the spool, the guide fingers provide a reciprocal guiding motion causing the cable to move across the face of the spool so that successive wraps of the cable around the spool are placed one aside the other across the length of the spool. Then the direction of guiding motion of the guide fingers is reversed, causing a second layer of the wrapped cable to be disposed atop the first layer and similarly in succeeding layers until the spool is filled. In this manner each cable is received on its respective spool in a series of concentric layers comprised of multiple side by side wraps of the cable. It will be appreciated that if it were not for the presence of the level wind mechanism just described, the cables would wind upon the spool in an erratic, irregular fashion and in general the cables would not be wound upon the spool at an equal speed.

An important feature of this level wind mechanism is the relative reciprocal speed of the guide fingers as compared to the rotating motion and the physical dimension of the cables upon the spools. For example, in a preferred embodiment of the present invention, each of the winch spools has an axial length of two inches. Each of the cables wound upon the spool has a diameter of ⅛ inch. Therefore, to lay upon the spool one layer of adjacent wraps of the ⅛ inch diameter cable, it would require sixteen wraps upon the spool. In order to allow for a slight spacing between adjacent wraps, the inventor has determined that it is desirable to place only fifteen wraps per layer upon the spool. In order to achieve this, it is required that the guide fingers make one pass across the spool for each 15 revolutions of the spool. The double threaded portion 112 of the level wind shaft 104 is so constructed that the guide fingers make one pass across the length of the double thread portion for each four revolutions of the level wind shaft 104. Therefore to achieve the desired relative motions of the level wind mechanism to the rotation of the spools, it is required that for each 15 revolutions of the spools, there be four revolutions of the level wind shaft. This reduction is achieved by means of the drive ratio of the small transfer gear 98 to the large transfer gear 100.

Figure 4:
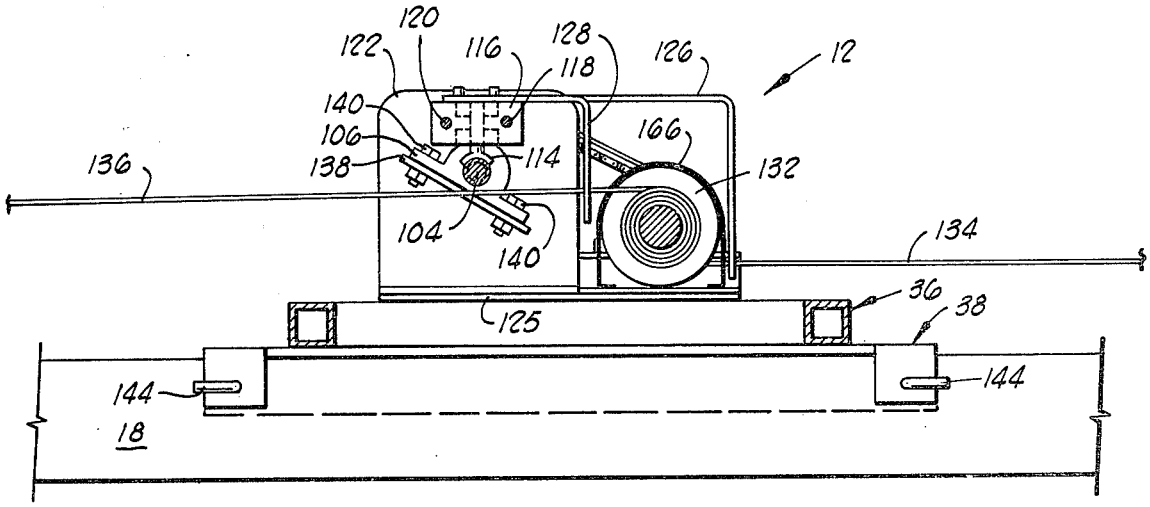
FIG. 4 is a partially sectional elevation view of the propulsion system of FIG. 3 taken along the lines 4—4.
Figure 5:
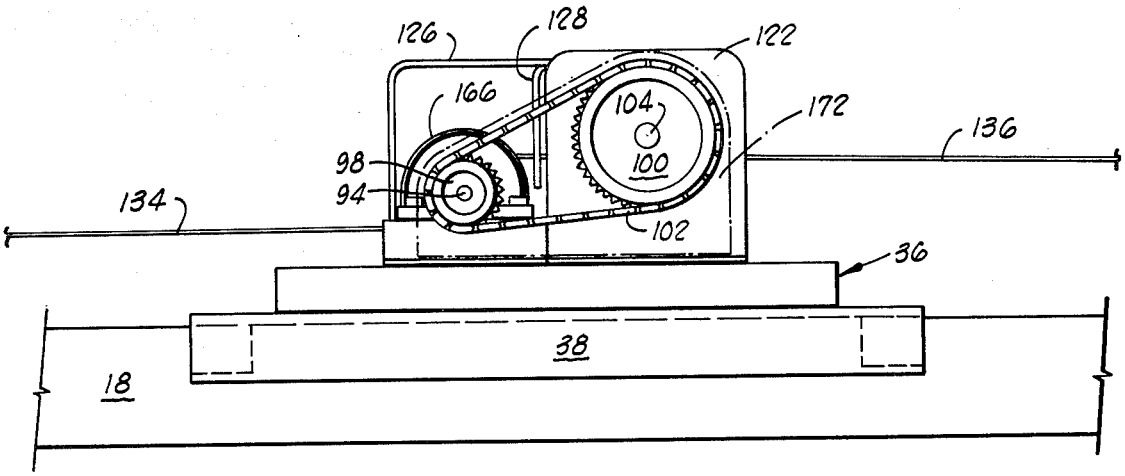
FIG. 5 is an elevation view of the propulsion system of FIG. 3 taken along the lines 5—5.

Referring now to FIG. 4, a partly sectional elevation view of the propulsion system 12 is shown. It will be noted that the pillow block 106 is mounted upon a support flange 138 extending perpendicular to level wind support plate 122. The pillow block 106 is mounted upon the support flange 138 by means of conventional slots in the support flange 138 through which are positioned bolts 140 so that the pillow block 106 may be adjustably located upon the support flange 138. The pillow block 108 is similarly mounted upon a support flange 142 as is seen in FIG. 3. Referring again to FIG. 4, the support flange 138 is aligned so as to be parallel to an imaginary line drawn between the rotational axis of the winch spool 132 and the rotational axis of the level wind shaft 104. With this arrangement, it is possible to substitute a pair of meshing gears for the chain and sprocket assemblies between the winch shaft 94 and the level wind shaft 104. This orientation of the pillow blocks 106 and 108 would allow the gear mounted upon level wind shaft 104 to be adjustably moved towards the center of the gear mounted upon the winch shaft 94 so as to provide the proper meshing interference.

The propulsion system 12 is mounted upon the spaced, substantially parallel screed boards 18 and 20. This mounting is achieved by means of the screed board clamp members 38 and 40. Each of the clamp members 38 and 40 is mounted upon its corresponding screed board 18 or 20 by means of a thumb screw 144 as is best seen in FIG. 6. The thumb screw 144 threadedly engages a bore in the tab 146 which is connected to the clamp member 38. As the thumb screw 144 is screwed inwardly, it engages the screed board 18 thereby securing the same between the thumb screw 144 and the downwardly extending flange 145 of the clamp member 38.

Each of the outer frame assemblies 14 and 16 is attached to the screed boards 18 and 20 by clamp members constructed in a fashion similar to the clamp members 38 and 40 just described. In this manner, the screed boards 18 and 20 are supported by three spanning support members, namely the frame 36 of the propulsion system 12, and the outer frame assemblies 14 and 16. The combination of the screed boards and the frame 36, and outer frame assemblies 14 and 16 provide a relatively rigid structure. Upon the outer frame assemblies 14 and 16 are rotatingly mounted the guide pulleys 148 and 150 respectively. Each of the guide pulleys 148 and 150 rotate about a vertical axis. The guide pulleys 148 and 150 engage the cables 136 and 134, respectively. The free ends of the cables 134 and 136 (not shown) are attached to the pouring frame or some other fixed structure to provide an external anchor for the cables.

The elongated guide shoe 22 is formed from a length of square tubing and has a downwardly facing tapered front end 152, as is seen in FIG. 2, and a blunt rear end 153. This tapered front end is provided so as to allow the elongated guide shoe 22 to engage guide supports 28 in a smooth manner. The guide supports 28 are preferably inserted in the ground surface 30 in such a manner that the horizontal bars 32 all lie within a common plane, but it is sometimes difficult to have them all exactly aligned. By providing the tapered front end 152 on the elongated guide shoe 22, said guide shoe is allowed to engage the horizontal bars of the guide support 28 at varying heights without hanging up against the guide supports.

Attached to the upper surface of the elongated guide shoe 22 is screed board stop bracket 154. The stop bracket 154 has an L-shaped configuration with a lower leg 156 which is rigidly connected to the guide shoe 22 by welding or other suitable means, and a vertical leg 158 extending approximately five inches above the guide shoe 22, and oriented for engagement with a vertical surface of the screed board 20. The vertical leg 158 has disposed therein a plurality of vertically spaced nail holes 160 which allow the vertical leg 158 to be fixedly attached to the screed board 20 if required.

The guide handles 24, as seen in FIGS. 1 and 2, are provided so as to allow for manual propulsion and/or adjustment of the position of the concrete screed machine 10. For example, it is sometimes desirable to provide a reciprocating motion of the screed boards 18 and 20 parallel to their longitudinal axes. This may be imparted by a human operator by means of the guide handles 24. Additionally, a remote control 162, mounted upon one guide handle 24 is used to control the speed of the prime mover 56 by means of control cable 164 which is attached at its other end to the throttle (not shown) of prime mover 56.

The winch spools 130 and 132 are provided with a cover 166, shown in phantom lines in FIG. 2, which has openings 168 and 170 which allow cables 134 and 136, respectively, to extend horizontally from their respective spools 130 and 132.

A drive gear cover 172 is provided, enclosing the gears 98 and 100 and the chain 102.

Operation

The operation of the concrete screed machine 10 is as follows. The screed machine 10 is used to finish the surface of an area of concrete poured within the pouring frame whose outer perimeter is partially defined by the pouring frame members 26 and 27. The screed machine 10 initially is placed closely adjacent and parallel to the pouring frame member 27. The elongated slide shoe 22 is initially located so that its rear end 153 is adjacent the pouring frame member 27, and it rests upon a plurality of guide supports 28 with its front end 152 oriented toward the direction in which the screed machine 10 will travel. Referring to FIGS. 1 and 2, it is seen that the screed boards 18 and 20 slidingly engage the top surface of the elongated guide shoe 22. When the operation of the screed machine is initiated, the screed board 20 is spaced from the vertical leg 158 of the screed board stop bracket 154. The screed boards 18 and 20 also slidingly engage at their other end the pouring frame member 26. The prime mover 56 is started thereby driving concurrently the winch shaft 94, the level wind shaft 104 and the vibrator shaft 70, along with the intermediate shafts as is readily seen. The vibrator shaft 70 causes the eccentric weight 72 to rotate, thereby imparting a vibrating motion to the entire concrete screed machine 10, and particularly to the screed boards 18 and 20 which engage the concrete surface. The winch and level wind mechanism comprised to the winch shaft 94 and the level wind shaft 104 cause the cables 134 and 136 to be wound upon their respective spools thereby imparting tensional forces in those cables and pulling the entire concrete screed machine 10 in a direction perpendicular to the length of the screed boards 18 and 20. Due to the level wind effect, the cables 134 and 136 are wound upon their respective spools at an even rate thereby moving each end of the screed board at equivalent speeds and retaining the orientation of the screed boards 18 and 20 generally perpendicular to the direction of travel of the screed machine 10.

After the screed machine 10 has traveled through a certain distance, the screed board 20 engages the vertical leg 158 of the screed board stop bracket 154. At this point, the elongated guide shoe 22 is then drawn along with the screed machine 10 as it continues to travel. If it is desired to fixedly attach the screed board 20 to the guide shoe 22 this may be done by inserting one or more nails (not shown) through the nail holes 160 and driving said nails into the screed board 20.

After the concrete screed machine 10 has traversed the entire length of the pouring frame as defined by the length of the pouring frame member 26, the guide shoe 22 is returned to its initial position as shown in FIG. 1, and the screed machine is relocated to the left of the position shown in FIG. 1 so that the screed boards 18 and 20 then engage the elongated guide shoe 22 at a point approximately equal to the point at which they originally engaged the pouring frame member 26. That area to the left of the elongated shoe, as seen in FIG. 1, is then poured with concrete and finished in a similar manner to that just described. The guide supports 28 are left embedded in the concrete and that portion of the surface directly above them is finally finished after removal of the screed machine 10.

During the traverse of the screed machine 10 its speed may be controlled by the remote control 162 which regulates the speed of the prime mover 56. Further adjustments in the speed at which the screed machine 10 is propelled may be achieved by selective positioning of the third belt 86 upon the variable ratio drive pulleys 82 and 84.

Thus, the concrete screed machine of the present invention is seen to be well adapted to carry out the objects and attain the ends and advantages mentioned as well as those inherent therein. While presently preferred embodiments of the invention have been described for the purpose of this disclosure, numerous changes in the construction and arrangement of parts can be made by those skilled in the art, which changes are encompassed within the spirit of this invention as defined by the appended claims.

What is claimed is:

1. A concrete screed machine comprising:
- a main frame;
- a prime mover mounted upon said frame;
- first and second winch means mounted upon said frame and driven by said prime mover;
- first and second cable means engaging said first and second winch means, respectively, and constructed for engagement with anchor means external to said screed machine;
- a level wind means mounted upon said frame for imparting reciprocal guiding motion to each of said cable means as they are wound upon their respective winch means, to pull each of said cable means towards said winch means at substantially equal speeds;
- a first outer frame assembly having a guide pulley for engaging said first cable means;
- a second outer frame assembly having a guide pulley for engaging said second cable means; and
- means for connecting said main frame and outer frame assemblies to a pair of substantially parallel spaced screed boards, each having first and second ends, so that as the cable means are wound upon the winch means, the screed boards are propelled in a direction substantially perpendicular to the length of the screed boards, and said first and second ends of said screed boards are propelled towards said anchor means at substantially equal speeds.

2. The screed machine of claim 1, further comprising:
- an elongated guide shoe, for sliding engagement with said screed boards.

3. The screed machine of claim 2 wherein said elongated guide shoe further comprises:
- a tapered front end;
- a rear end; and
- a screed board stop bracket for engaging a vertical surface of one of said screed boards.

4. The screed machine of claim 1 wherein said level wind mechanism further comprises:
- a level wind shaft, having a double threaded portion;
- drive means connecting the winch means and the level wind shaft; and
- guide means connected to the double threaded portion for providing reciprocal guiding motion of the cable means.

5. The screed machine of claim 4 wherein said guide means further comprises:
- a pair of substantially parallel guide shafts connected to the main frame and oriented substantially parallel to the rotational axis of the winch means;
- a carrier block, having disposed therein a pair of substantially parallel bores for receiving said guide shafts;
- a follower key engaging the double threaded portion of the level wind shaft and engaging the carrier block; and
- a guide finger, attached to the carrier block for engagement with the cable means.

6. The screed machine of claim 4 further comprising:
- a pair of pillow blocks engaging the level wind shaft; and
- a pair of support flanges, connected to the main frame, for mounting the pillow blocks to allow adjustable movement of the pillow blocks in a direction substantially parallel to an imaginary line between the rotational axes of the winch means and the level wind shaft.

7. The screed machine of claim 1 further comprising:
vibrator means attached to said main frame; and
drive means connecting the vibrator means and the prime mover.

8. The screed machine of claim 1 further comprising:
a guide handle for engagement with one of said screed boards; and
remote control means, mounted upon said guide handle for regulating the speed of the prime mover.

9. A concrete screed machine comprising:
a main frame for mounting upon a pair of substantially parallel screed boards;
a prime mover mounted upon the frame;
an idler shaft mounted upon the frame;
first drive means connecting the prime mover and the idler shaft;
a vibrator shaft mounted upon the frame;
second drive means connecting the vibrator shaft and the idler shaft;
an eccentric weight attached to the vibrator shaft;
a gear box having an input shaft and an output shaft;
third drive means connecting the input shaft and the idler shaft;
a winch means mounted upon the frame;
a coupling, for connecting the winch means and the output shaft, said coupling including a shear pin for permitting automatic disengagement of the output shaft and the winch means if the winch means is restrained from rotating;
a level wind shaft mounted upon the frame;
fourth drive means connecting the winch means and the level wind shaft;
cable means for engaging the winch means; and
a level wind means engaging the level wind shaft for providing a reciprocal guiding motion of the cable means across the winch means so that said cable means is received on the winch means is a series of concentric layers comprised of multiple side by side wraps of the cable means.

10. The apparatus of claim 9 further comprising:
an outer frame member, for engaging said screed boards, said outer frame member being spaced from the main frame; and
a cable guide pulley, attached to said outer frame member, for engagement with the cable means and for rotation about a vertical axis.

11. The apparatus of claim 10 wherein:
said winch means is further comprised of first and second adjacent aligned winch spools; and
said cable means is further comprised of first and second cables connected to said first and second spools, respectively.

12. The apparatus of claim 11 wherein said level wind means is further comprised of first and second guide fingers for reciprocal guiding engagement with said first and second cables, respectively.

13. The apparatus of claim 12 further comprising:
a pair of guide handles for attachment to each of the screed boards; and
remote means, mounted on one of said guide handles, for controlling said prime mover.

14. An improved guide means for a screed machine, comprising:
a pair of substantially parallel spaced screed boards for traveling across a surface in a direction substantially perpendicular to the length of said screed boards;
an elongated guide shoe for sliding engagement with said screed boards, said guide shoe having a tapered front end; and
a screed board stop means, attached to the guide shoe, for engaging a vertical surface of one of said screed boards, so that said screed boards may initially slide relative to said guide shoe until said stop means is engaged.

15. The improved guide means of claim 14 wherein said screed board stop means is further comprised of:
a vertical leg, attached to the guide shoe, and having disposed therein a nail hole for allowing attachment of the vertical leg to one of said screed boards.

16. The improved guide means of claim 15 further comprising:
a plurality of guide supports having a horizontal bar for sliding engagement with the guide shoe and vertical extensions on either end of the horizontal bar for preventing the guide shoe from sliding out of engagement with the guide supports.

* * * * *